US006234776B1

(12) United States Patent
Hayashi et al.

(10) Patent No.: US 6,234,776 B1
(45) Date of Patent: May 22, 2001

(54) VANE PUMP

(75) Inventors: Tetsuji Hayashi; Kenichi Kuga, both of Tokyo (JP)

(73) Assignee: Kayaba Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/077,822

(22) PCT Filed: Nov. 29, 1996

(86) PCT No.: PCT/JP96/03505

§ 371 Date: Jan. 8, 1999

§ 102(e) Date: Jan. 8, 1999

(87) PCT Pub. No.: WO97/21032

PCT Pub. Date: Jun. 12, 1997

(30) Foreign Application Priority Data

Dec. 6, 1995 (JP) ..... 7-344934

(51) Int. Cl.[7] ..... F03C 2/00
(52) U.S. Cl. ..... 418/133; 418/259
(58) Field of Search ..... 418/133, 259

(56) References Cited

U.S. PATENT DOCUMENTS 4,842,500 * 6/1989 Fujie et al. ..... 418/133

FOREIGN PATENT DOCUMENTS 58-53690 * 3/1983 (JP) ..... 418/259
59-23091 * 2/1984 (JP) ..... 418/259
59-180088 * 10/1984 (JP) ..... 418/259
59-190489 * 10/1984 (JP) ..... 418/259
81-01446 * 5/1981 (WO) ..... 418/259

* cited by examiner

*Primary Examiner*—Thomas Denion
*Assistant Examiner*—Theresa Trieu
(74) *Attorney, Agent, or Firm*—Rabin & Champagne, P

(57) ABSTRACT

This invention relates to a vane pump having a cover of simple construction and which permits reduction of production costs. A groove-shaped low pressure port 6A and a branch groove 6 split into two are formed in the cover joined to a body. A pin extending by a predetermined amount from an end face of the body is implanted in a side plate. A throughhole through which the pin passes is formed in a cam ring, and a concave part 25 of predetermined depth for engaging with the end of the pin is formed in the cover. An escape hole 24 is also formed in the cover for housing the tip end of the drive shaft extending from the end face of the body. A shoulder part is formed on the inner circumference of a shaft hole in the body which engages or disengages with a step between the large diameter part and the small diameter part of the drive shaft.

5 Claims, 13 Drawing Sheets

VANE PUMP

FIELD OF THE INVENTION

This invention relates to a vane pump, and in particular to a vane pump which is suitable for supplying oil pressure to a power steering device of a vehicle.

BACKGROUND OF THE INVENTION

A vehicle such as an automobile is provided with a power steering device which uses oil pressure. Conventionally, to supply this oil pressure, a vane pump is used such as is shown in FIG. 13 and FIG. 14.

The vane pump houses a cam ring 30, a rotor 31 and vanes 32 which form a pump cartridge 3 in the inner circumference of a body 107. The cam ring 30 and rotor 31 are disposed between a cover 106 tightened to the body 107 and a side plate 108 fixed to the inner circumference of the body 107.

The rotor 31 is joined to a drive shaft 50' which passes through the body 107. A pulley is joined to a base end 50'B of the drive shaft 50', and the pulley is connected with an engine. The drive shaft 50' drives the rotor 31 and vanes 32. The drive shaft 50' is supported by a bearing 120 provided in the body 107 and a bearing 121 provided in the cover 106. A tip end 50'A on the bearing 121 side of the drive shaft 50' is housed inside the cover 106 without penetrating the cover 106.

A ring groove 52 is formed at a predetermined position on the outer circumference of the drive shaft 50', and a cir clip 33 engages with the ring groove 52. The relative displacement of the rotor 31 and drive shaft 50' in the axial direction is thereby regulated, and the rotor 31 is joined to the drive shaft 50'.

When a force acts on the drive shaft 50' in such a direction as to push it away from the body 107, the cir clip 33 comes in contact with the rotor 31 which slides on the side plate 108, and the displacement of the drive shaft 50' in the axial direction is thereby regulated.

A high pressure chamber 101 formed between the inner circumference of the body 107 and the side plate 108, a passage 111 connecting the high pressure chamber 101 and a flowrate control valve 4, an intake connector 105 connecting with the outside of the body 107, and a low pressure passage 109 for recirculating excess hydraulic fluid in the flowrate control valve 4 to the pump cartridge 3, are provided inside the body 107.

Hydraulic fluid is supplied under pressure from the pump cartridge 3 via a connecting hole in the side plate 108, and the required amount of hydraulic fluid is supplied to the power steering device via the passage 111 and flowrate control valve 4.

Surplus flowrate from the flowrate control valve 4 and hydraulic fluid from the intake connector 105 flow into the cover 106 via the low pressure passage 109. The hydraulic fluid is sent to an intake area of the pump cartridge 3 via branch passages 102, 102 formed in the cover 106. As the cover 106 comprises the branch passages 102, 102, it is formed by demolding using a core. A thick part 106A of predetermined thickness is formed between the branch passages 102 and a contact surface of the cover 106 with the rotor 31 and vanes 32, and strength is thereby ensured.

Hydraulic fluid which has leaked from the end face of the cam ring 30, and from a gap between the rotor 31 and the side plate 108 flows back to the low pressure passage 109 from the outer circumference of the bearing 120 via a drain passage 112 inclined at a predetermined angle to the drive shaft 50'.

However, in the aforesaid prior art, the drive shaft 50' is supported by the bearing 120 in the body 107 and the bearing 121 in the cover 106. Therefore, when the vane pump is assembled, an assembly step must be provided to press the bearing 121 into the cover 106. The contact surfaces between the cover 106 and the body 107 also must be finished with a predetermined surface precision in order to ensure orthogonality of the cover 106 and drive shaft 50' and concentricity of the bearing 121 and drive shaft 50'. Therefore, the number of machining steps increases, machining time increases, and production costs rise.

The displacement of the drive shaft 50' to the right-hand side of FIG. 13 is restricted by the cir clip 33, and when it displaces to the left-hand side, the end 50'A of the drive shaft 50' comes in contact with the inner circumference of the cover 106. Therefore, the depth of the hole into which the bearing 121 is inserted requires to be strictly controlled. As machining is necessary after casting the cover 106, the number of machining steps and machining time increase, and production costs increase.

As shown in FIG. 14, the positional relationship of the cam ring 30 and side plate 108 is determined by a pair of dowel pins 42, 42 which pass through the cam ring 30 and side plate 108. The dowel pins 42are pressed into positioning holes, not illustrated, formed on the surface of the cover 106 on which the rotor 31 and vanes 32 slide. Therefore, the number of machining steps and machining time increase in order to ensure machining precision of this hole.

The vane pump having the aforesaid construction is assembled by assembling each component sequentially to the body 107 or cover 106, so the number of assembly steps increases. Further, automation of assembly steps is difficult, and productivity cannot be improved.

This invention, which was conceived in view of the aforesaid problems, largely reduces the number of steps used in assembling the vane pump by reducing the steps for machining the cover, and thereby improves productivity. It is a further object of the invention to provide a vane pump whereof the assembly can be automated.

DISCLOSURE OF THE INVENTION

This invention provides a vane pump comprising:

- a cam ring comprising a rotor joined to a drive shaft and vanes provided in the rotor such that they are free to move in or out,
- a body supporting the drive shaft and housing the cam ring,
- a side plate on which are symmetrically provided first low pressure ports corresponding to an intake area of the cam ring and a high pressure port corresponding to a discharge area and connected to a high pressure chamber in the body,
- an intake chamber formed between an inner circumference of the body and an upper outer circumference of the cam ring connecting with a low pressure passage for leading hydraulic fluid from the outside,
- a branch passage formed between the inner circumference of the body and the upper outer circumference of the cam ring connecting the first low pressure ports of the side plate with the intake chamber, and
- a cover comprising an end face joined to an open end face of the body which comes in contact with one end face of the cam ring, wherein second low pressure ports are symmetrically arranged as depressions at positions corresponding to the intake area of the cam ring, and a low pressure distributing groove provided as a depression connected to the intake chamber which splits into two along the upper outer circumference of the cam ring towards the second low pressure ports, and a pin implanted in the side plate whereof a tip extends by a predetermined amount from the open end face of the body towards the cover, wherein a throughhole is formed in the cam ring through which the pin passes, a concave part of predetermined depth is formed in the cover which engages with the tip of the pin, and an escape hole of predetermined depth for housing a tip end of the drive shaft is formed in the end face of the cover at a position corresponding to the drive shaft.

When the rotor housed inside the cam ring is driven, on one end face of the cam ring, hydraulic fluid in the intake chamber connected to the low pressure passage is aspirated from the second low pressure port via low pressure distributing branch grooves in the cover end face, while on the other end face, it is aspirated to the intake area of the cam ring from between the first low pressure port of the side plate and the end face of the cam ring via branch passages connected to the intake chamber.

Hydraulic fluid discharged from the discharge area of the cam ring is supplied under pressure to the outside through the flowrate control valve from the high pressure chamber in the body via the side plate. Hydraulic fluid is supplied to the second low pressure port from the cover side via the low pressure distributing branch grooves formed in the end face of the cover.

As this vane pump is provided with the pin in the side plate, when the throughhole of the cam ring is penetrated by the pin and the rotor and vanes are housed within the inner circumference of the cam ring, the side plate and pump cartridge can be assembled in a one-piece construction. When this side plate and pump cartridge housed together inside the body in a one-piece construction are inserted in the body and the cover is joined to the body, the intake chamber and branch passages can be formed easily. As the pin that extends from the open end face of the body engages with the concave part of the cover, the side plate and cam ring can be attached to the body in a predetermined positional relationship.

One end of the drive shaft extending from the end face of the body is housed in the escape hole formed in the end face of the cover and does not come in contact with the cover. Therefore, it is not necessary to provide a bearing or pin in the cover as is required in the aforesaid prior art. Therefore, the number of steps and time required to machine the cover are reduced, the number of parts is reduced, and ease of assembly is improved. It is moreover easy to automate assembly steps.

According to an aspect of this invention, at least one set of the pin is symmetrically provided in the side plate, plural througholes for passing the pins through are formed in the cam ring, and plural concave parts joined to tips of the pins in the end face of the cover are symmetrically formed relative to the drive shaft supported by the body.

At least one set of pins which are implanted symmetrically about the axis in the side plate respectively pass through in the cam ring, and the side plate and cam ring are joined together in a predetermined positional relationship. When the side plate and cam ring are assembled in the body, and the cover is joined to the body, plural concave parts formed in the end face of the cover engage with the pins, and the side plate and cam ring can easily be positioned in a predetermined positional relationship relative to the body. Therefore ease of assembly is improved, and the assembly steps can easily be automated.

According to another aspect of this invention, the pin is pressed into a hole formed in the side plate. The aforesaid pin is fixed, and there is no need to fix the pin to the cover as is required in the aforesaid prior art. Therefore, construction of the cover is simplified, production costs can be kept low, and ease of assembly is enhanced.

According to yet another aspect of this invention, the drive shaft is joined to the rotor in an axial direction by a cir clip, the drive shaft comprises a small diameter part having a predetermined diameter on the cover side and a large diameter part having a larger diameter than the small diameter part on the body side, the large diameter part is supported by the body, a step is formed between the small diameter part and the large diameter part, and a shoulder part is provided which comes in contact with the step at an end of a shaft hole in the body.

The drive shaft is joined to the rotor in the axial direction by the cir clip in the small diameter part, and axial displacement in such a direction as to push the drive shaft away from the body is restricted. Due to this, the drive shaft does not fall off the body.

As displacement of the drive shaft in the axial direction towards the cover is restricted by the shoulder part provided in the body, the tip end of the drive shaft does not come in contact with the cover. Therefore, there is no need to provide a means to restrict axial displacement of the drive shaft in the cover as is required in the aforesaid prior art. Therefore the construction of the cover is simplified, the number of parts and number of machining steps are reduced, and production costs can be reduced.

When the drive shaft is inserted into the bearing in the body from the small diameter part side, the step is stopped by the shoulder part. Due to this, the special positioning means is unnecessary, and assembly steps can easily be automated.

PREFERRED EMBODIMENTS OF THE INVENTION

The invention will now be described in more detail with reference to the attached drawings.

FIG. 1–FIG. 11 show one embodiment of a vane pump of this invention.

Figure 1:
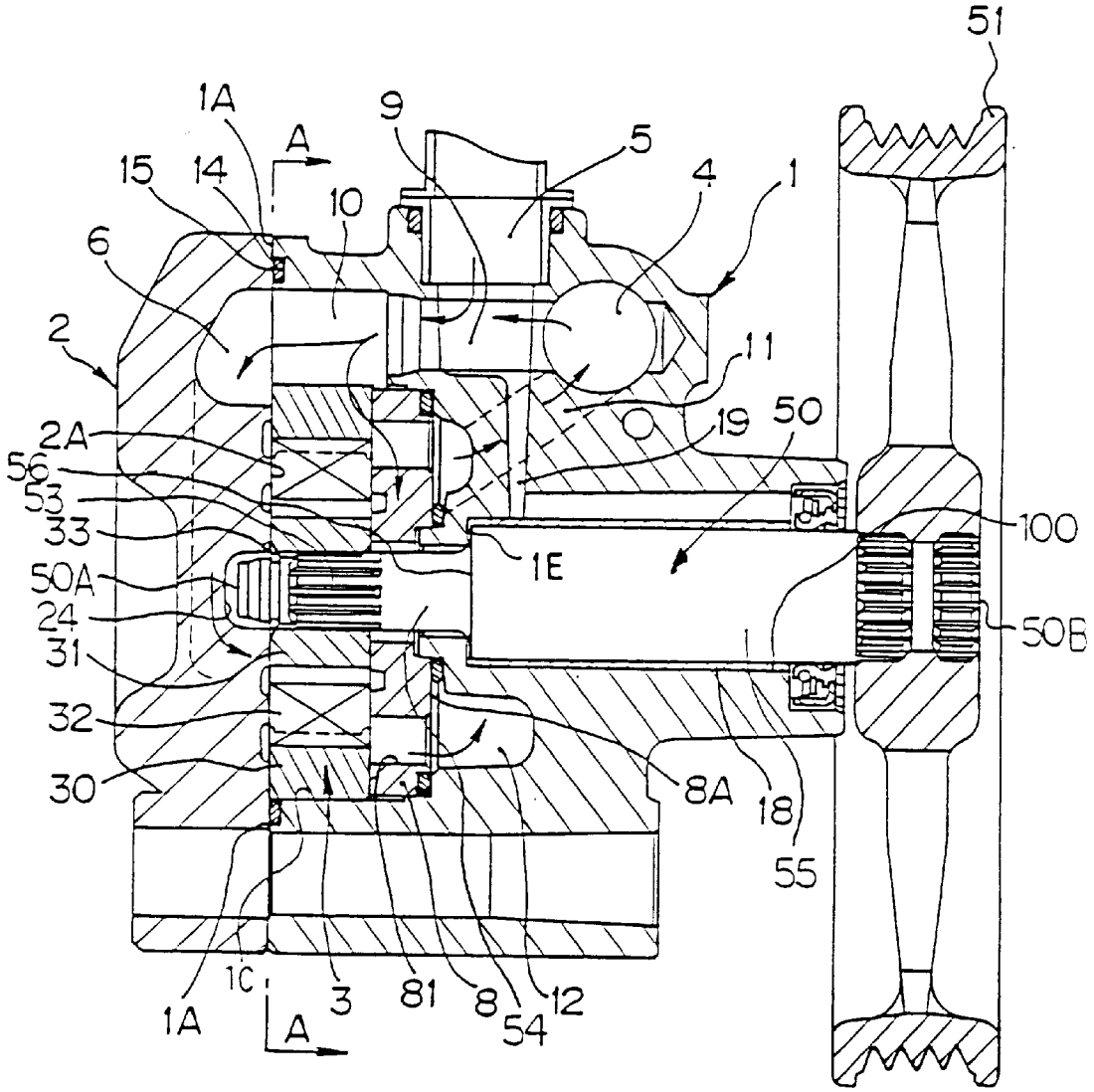
FIG. 1 is a cross-sectional view of a vane pump showing one embodiment of this invention.
Figure 2:
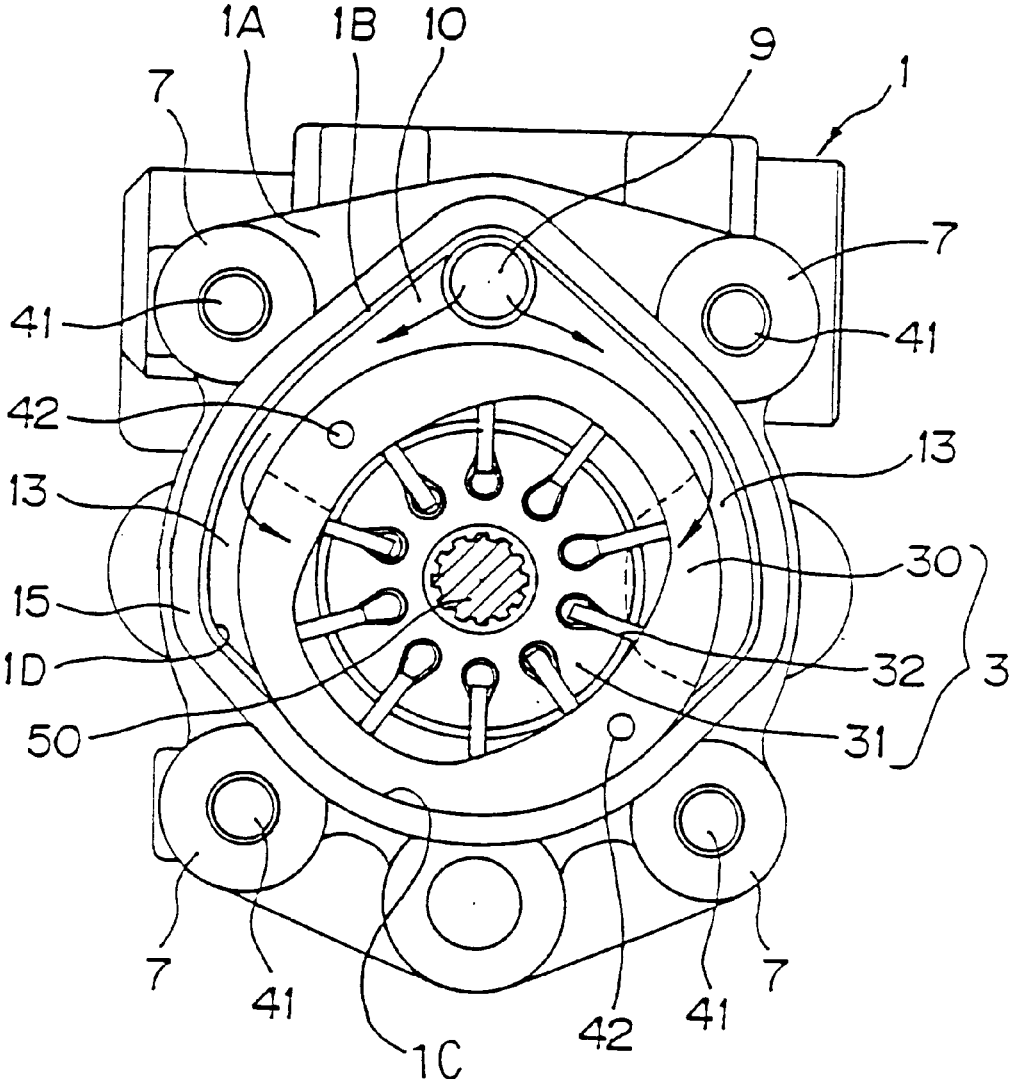
FIG. 2 is a view taken in the direction of the arrow A of FIG. 1.
Figure 3C:
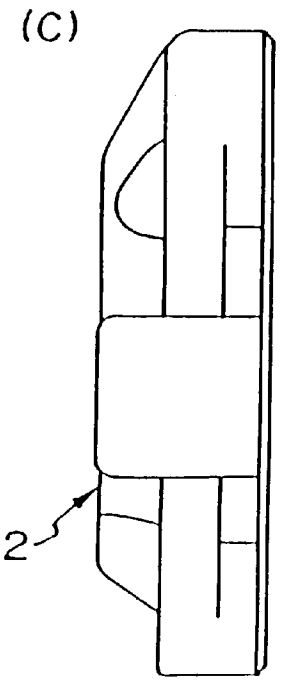
FIG. 3 shows a cover. (A) is a left side view of FIG. 1, (B) is a cross-sectional view taken along a line B—B in (A), and (C) is a side view of (A).
Figure 3B:
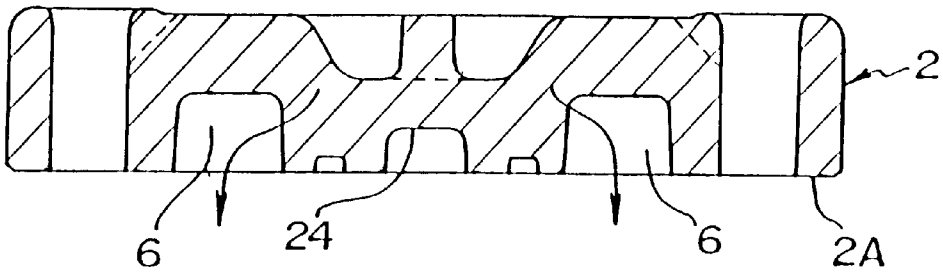
Figure 3A:
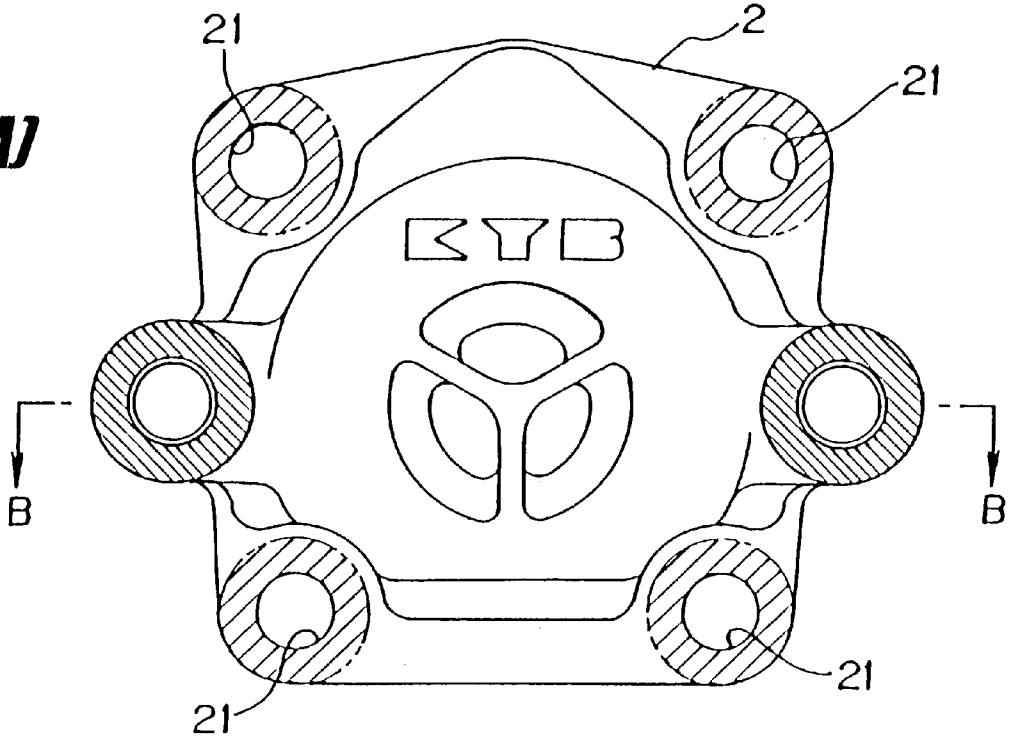

In FIG. 1 and FIG. 2, a body 1 supports a drive shaft 50 to which a pulley 51 is joined at a base end 50B. A valve hole housing a flowrate control valve 4 is provided in the body 1.

The body 1 houses a pump cartridge 3 comprising a side plate 8 and a cam ring 30 housing a rotor 31 free to rotate, the pump cartridge 3 being inserted from an open end face 1A of body 1. A cover 2 is joined to the open end face 1A.

A shaft hole 100 passes substantially through the center of the body 1. The drive shaft 50 that passes through the shaft hole 100 is supported by a bearing metal 18 fixed to the inner circumference of the shaft hole 100.

Figure 11:
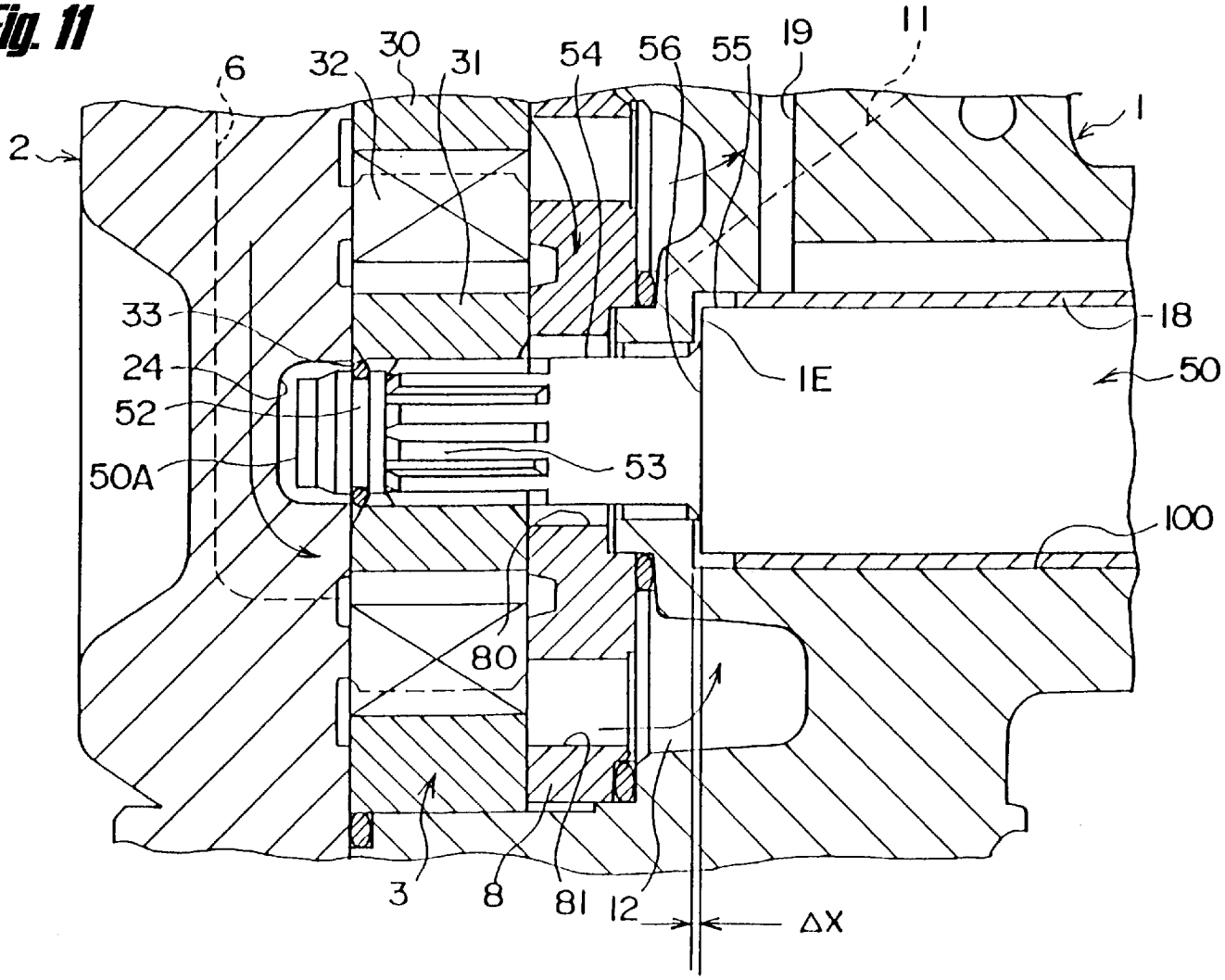
FIG. 11 is a partial enlarged view of FIG. 1 showing an area near a step of the drive shaft.

As shown in FIG. 1 and FIG. 11, the rotor 31 engages with splines 53 provided on a tip end 50A side of the drive shaft 50. Its rotation relative to the drive shaft 50 is restricted, but its relative displacement in the axial direction is permitted.

The pulley 51 is joined to the base end 50B which extends to the right-hand side of FIG. 1 and FIG. 11 from the body 1. The pulley 51 is connected to an engine via a belt, not shown, and the drive shaft 50 rotates the rotor 31 due to the drive force of the engine.

The flowrate control valve 4 is housed in the valve hole formed on the pulley 51 side in the body 1 so that it is effectively perpendicular to the drive shaft 50, as shown in FIG. 2. Hydraulic fluid whereof the flowrate is regulated is supplied under pressure to the outside of the vane pump from a discharge port, not shown, and is supplied for example to a power steering device.

In FIG. 1, the body 1 is formed so that the tip end 50A of the drive shaft 50 opposite to the pulley 51 extends by a predetermined length from the open end face 1A of the body 1. A concave space is formed in the body 1 from the open end face 1A, and the pump cartridge 3 and side plate 8 being housed in this space. The cover 2 which is formed by diecasting is tightened to the open end face 1A of the body 1.

The pump cartridge 3 comes in contact with an end face 2A of the cover 2 opposite to the body 1. The side plate 8 is interposed between the pump cartridge 3 and a base of the inner circumference of the body 1 which is formed in a concave shape. The cam ring 30 in the pump cartridge 3 is gripped between the side plate 8 and cover 2.

The pump cartridge 3 comprises the rotor 31 which engages with splines 53 on the drive shaft 50 inside the cylindrical cam ring 30, and vanes 32 supported by the rotor 31 which slide on the inner circumference of the cam ring 30 as shown in FIG. 2.

Figure 9A:
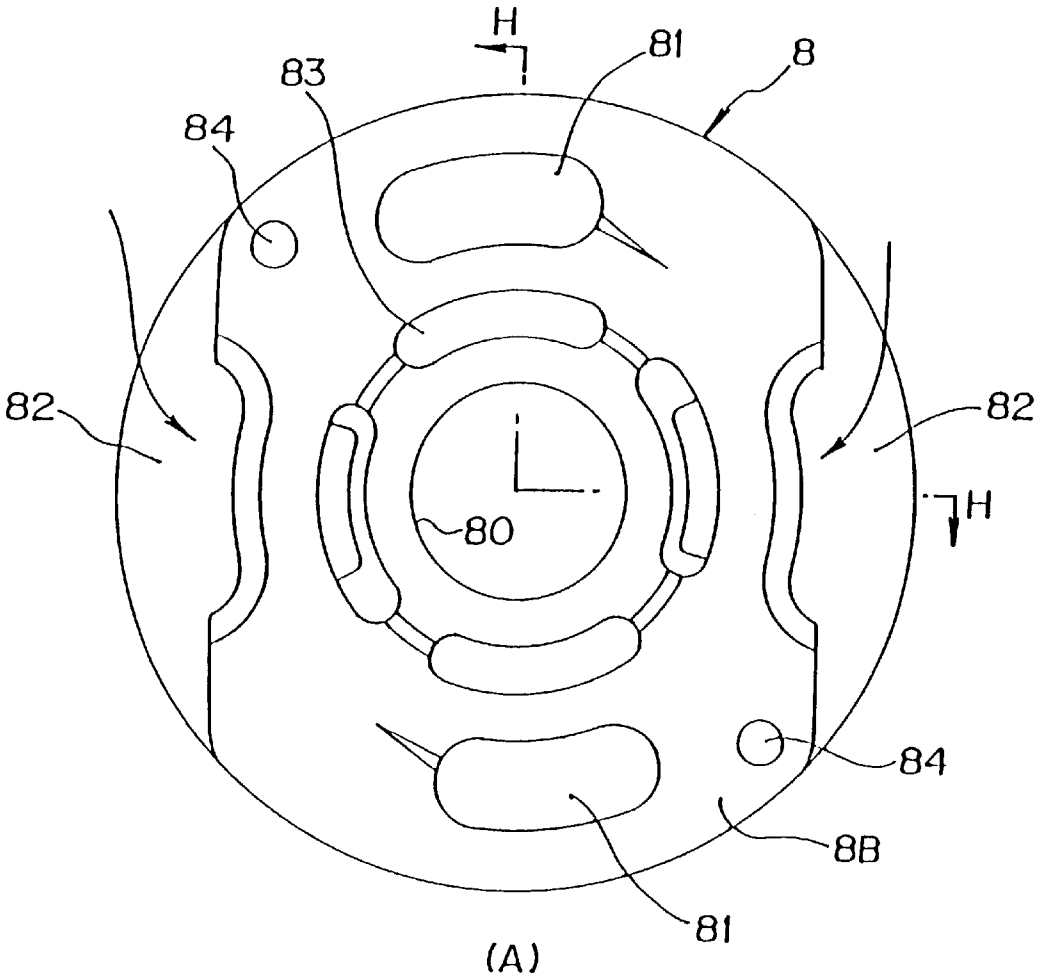
FIG. 9 shows a side plate. (A) is a front view, and (B) is a cross-sectional view taken along a line H—H of (A).
Figure 9B:
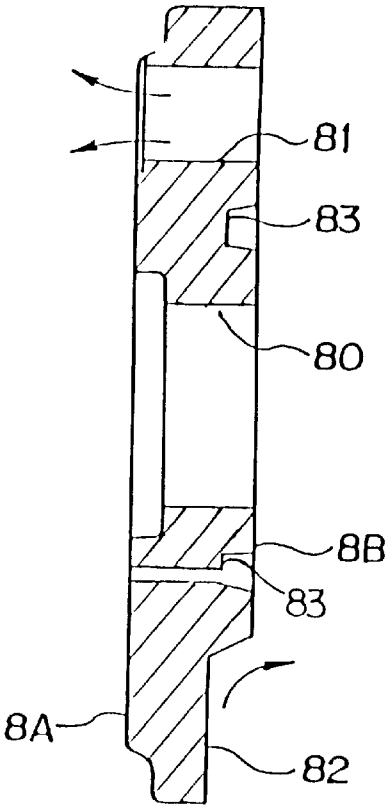
Figure 10A:
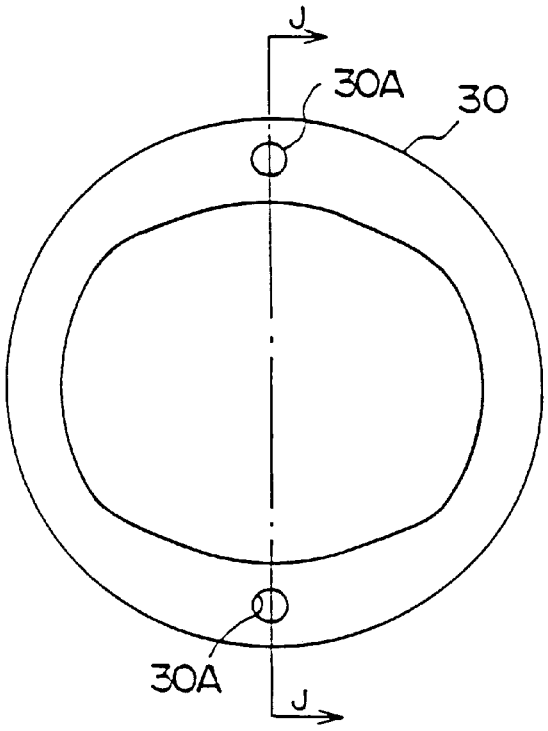
FIG. 10 shows a cam ring. (A) is a front view, and (B) is a cross-sectional view taken along a line J—J of (A).

As shown in FIG. 10, a pair of engaging holes 30A, 30A are symmetrically formed in the cam ring 30. A pair of dowel pins 42, 42 have one of their ends fixed in holes 84, 84 in the side plate 8 which is substantially disk-shaped as shown in FIG. 9. When the dowel pins 42, 42 are passed through the engaging holes 30A, 30A, the rotation of the cam ring 30 is restricted, and the pump cartridge 3 and side plate 8 are joined in a predetermined positional relationship. The side plate 8 is formed by sintering or the like.

A discharge area of the pump cartridge 3 faces a high pressure port 81 in the side plate 8, and is connected with the high pressure chamber 12 in the body 1 in a predetermined positional relationship. Likewise, an intake area of the pump cartridge 3 is connected with first and second low pressure ports 82, 6A formed in the side plate 8 and cover 2 (FIG. 9, FIG. 4) in a predetermined positional relationship. Due to this, the inner circumference of the cam ring 30 can aspirate hydraulic fluid substantially uniformly from both sides in the axial direction.

In FIG. 1, the lower part of a cylindrical intake connector 5 joined to the upper part of the body 1 connects with a low pressure passage 9 formed substantially parallel to the drive shaft 50. The left-hand side of this low pressure passage 9 in the figure also opens into an upper position in the base of the concave space of the body 1.

An intake chamber 10 is formed between the upper inner circumference of the concave space of the body 1 and the upper outer circumference of the cam ring 30 and side plate 8. The low pressure passage 9 which opens into the base of the inner circumference of the concave space connects with the intake chamber 10, and the right-hand side of the low pressure passage 9 connects with a bypass side of the flowrate control valve 4 which discharges surplus flowrate. Surplus flowrate from the flowrate control valve 4 and low pressure hydraulic fluid supplied from the intake connector 5 are combined, and flow into the intake chamber 10 formed in the body 1 via the low pressure passage 9.

The high pressure chamber 12 connected to the high pressure port 81 of the side plate 8, is connected to the flowrate control valve 4 via a passage 11 which slopes upwards as shown in FIG. 1. Hydraulic fluid which has leaked from the pump cartridge 3 flows toward the pulley 51 along the drive shaft 50, and is led to the low pressure passage 9 via a drain passage 19 provided from the lower end of the intake connector 5 to the drive shaft 50. The axial line of this drain passage 19 is formed in a line with the intake connector 5 in a plane substantially perpendicular to the drive shaft 50.

The side plate 8 interposed between the base of the concave space of the body 1 and the pump cartridge 3 is formed by a disk-shaped member as shown in FIG. 9(A), (B). An end face 8A comes in contact with the body 1, and an end face 8B comes in contact with the cam ring 30.

Hence, as described hereabove, the pair of high pressure ports 81, 81 are formed symmetrically in the side plate 8 on either side of the drive shaft 50 at a position corresponding to the discharge area of the cam ring 30.

A pair of steps at positions distant by 90° from the high pressure ports 81, 81 in a circumferential direction are formed on the surface 8B which comes in contact with the cam ring 30 and on which the rotor 31 and vanes 32 slide. The steps form low pressure ports 82, 82, which are first low pressure ports. These low pressure ports 82 are formed in a gap between the cam ring 30 and side plate 8, and connect with the intake chamber 10 surrounding the upper outer circumference of the cam ring 30 and side plate 8.

As shown in FIG. 2, hydraulic fluid aspirated from the low pressure passage 9 open to the part above the cam ring 30 to the intake chamber 10, is led to the low pressure ports 82, 82 opening between the cam ring 30 and side plate 8 via branch passages 13, 13 along the outer circumference of the cam ring 30.

Figure 5:
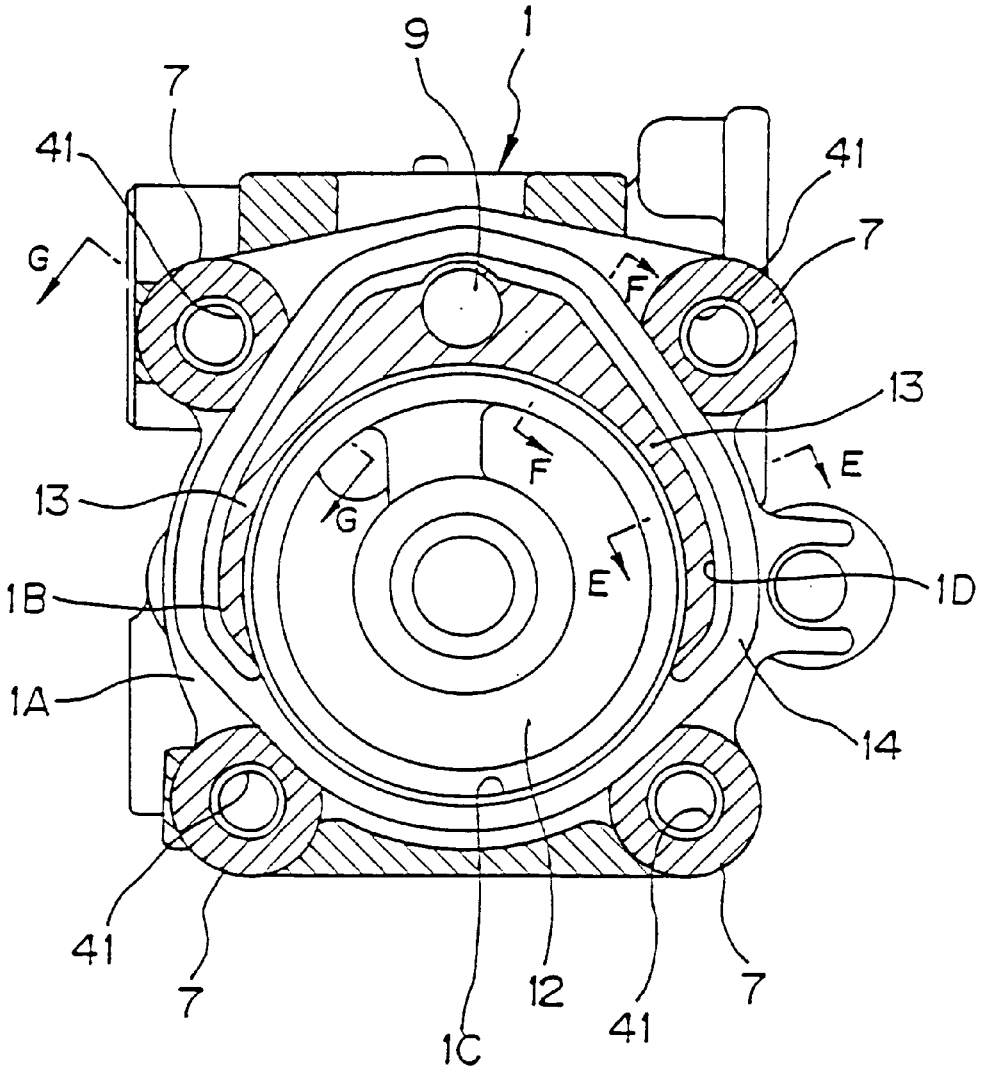
FIG. 5 shows the body alone and is a view taken in the direction of the arrow A of FIG. 1.
Figure 6:
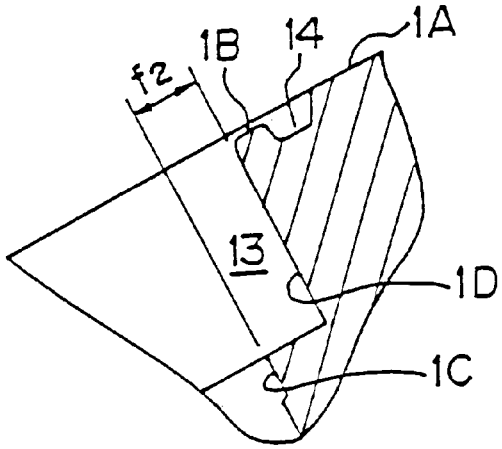
FIG. 6 is a cross-sectional view taken along a line E—E of FIG. 5.
Figure 7:
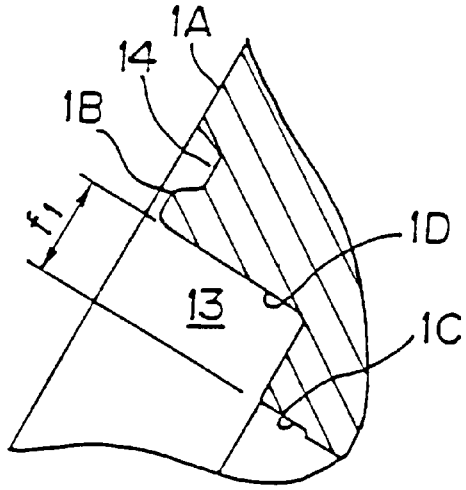
FIG. 7 is a cross-sectional view taken along a line F—F of FIG. 5.

Branch passages 13 are on the opening side of a concave space 1C of predetermined internal diameter engaging with the outer circumference of the side plate 8. These branch passages 13 are formed between an inner wall 1D formed on the inner circumference of the body 1 and the upper outer circumference of the cam ring 30, as shown in FIG. 5–FIG. 7. The widths of these branch passages 13 become progressively larger towards the intake chamber 10 as shown in FIG. 6 and FIG. 7 (f1>f2).

On the side plate 8 side of the cam ring 30, hydraulic fluid which has flowed into the intake chamber 10 via the branch passages 13, 13 is distributed to the left and right along the cam ring 30. This hydraulic fluid is aspirated almost uniformly into the intake area of the cam ring 30 from the left and right of FIG. 2 via the low pressure ports 82.

A substantially annular vane back pressure groove 83 of predetermined depth is formed in the end face 8B of the side plate 8 so as to lead back pressure to the bases of the vanes 32.

Branch grooves 6, 6 of predetermined depth are formed as low pressure distributing grooves in the end face 2A of the cover 2 from a position facing the low pressure passage 9 opening into the body 1 along the outer circumference of the cam ring 30 in contact with the end face 2A.

Figure 4B:
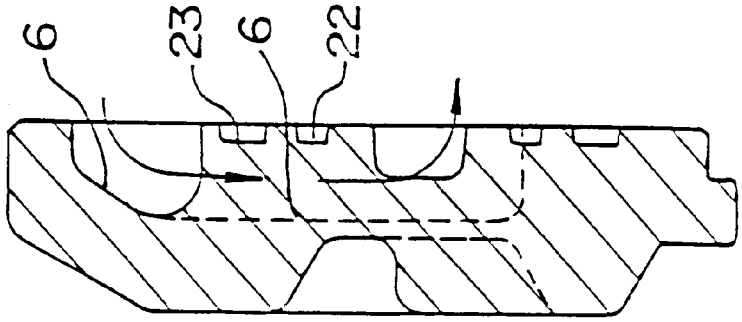
FIG. 4 shows the cover. (A) is a front view of the cover from the side of a body, and (B) is a cross-sectional view taken along a line D—D in (A).
Figure 4A:
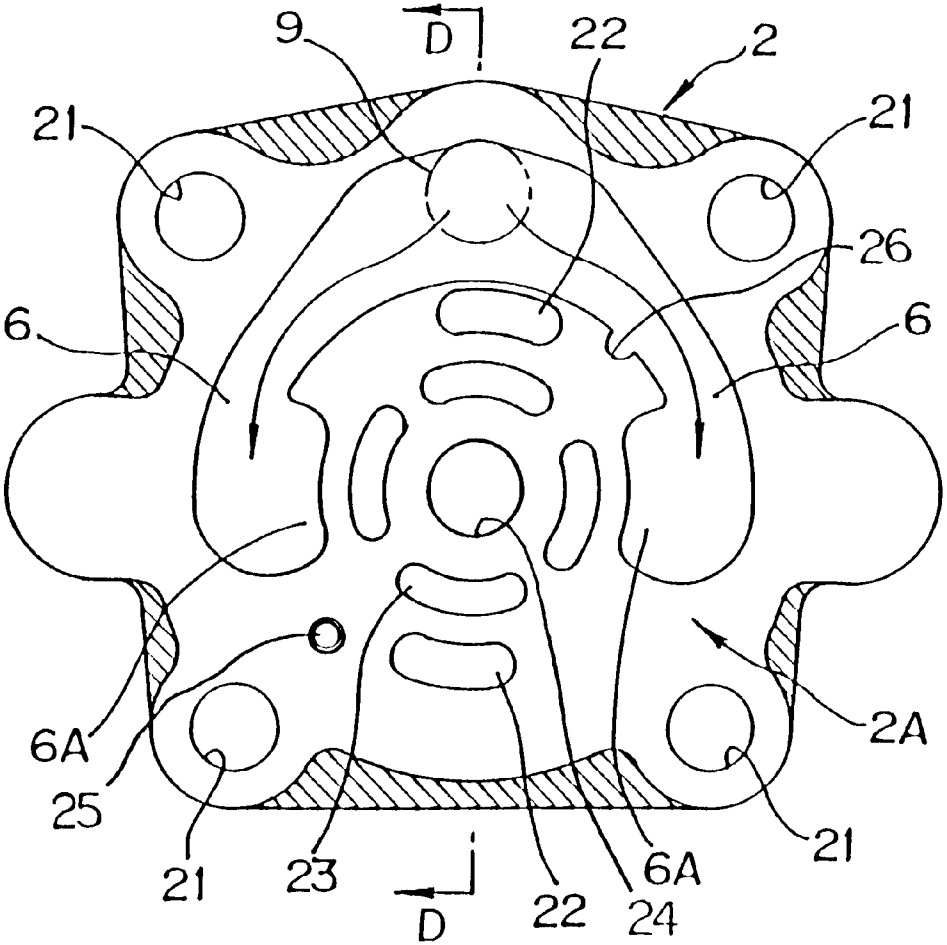

As shown in FIG. 4(A), the branch grooves 6, 6 are formed from a position 9' facing the low pressure passage 9 up to the horizontal direction (left-right direction in the figure) spanning an escape hole 24. The escape hole 24 is formed at a predetermined depth so that the tip end 50A of the drive shaft 50 does not come in contact with the end face 2A. The branch grooves 6, 6 extend further in a substantially horizontal direction from their lower ends to the escape hole 24. These extension grooves are formed at a predetermined depth as the pair of low pressure ports 6A, 6A facing the intake area of the cam ring 30. These low pressure ports 6A, 6A comprise the second low pressure ports.

Therefore, hydraulic fluid from the intake chamber 10 is distributed to the left and right from the upper part along the branch grooves 6, 6. This hydraulic fluid is aspirated substantially uniformly from the left-right direction of FIG. 4 to the intake area of the cam ring 30 via the pair of low pressure ports 6A, 6A.

Due to the branch passages 13, 13 formed between the upper outer circumference of the cam ring 30 and the inner circumference of the body 1, the low pressure ports 82, 82 formed as steps in the side plate 8 and the branch grooves 6, 6 formed in the cover 2, the pump cartridge aspirates hydraulic fluid substantially uniformly to both sides of the axial direction of the low pressure ports 82, 82 and the low pressure ports 6A, 6A formed in a horizontal direction.

As in the case of the side plate 8, a substantially circular vane back pressure groove 23 is also formed in the end face 2A of the cover 2 at a position corresponding to the base ends of the vanes 32 in the rotor 31. Due to this, back pressure can be led to the base ends of the vanes 32 via the vane back pressure groove 83 in the side plate 8.

The body 1 and cover 2 are tightened by bolts. As shown in FIG. 5 and FIG. 7, plural bolt seats 7 comprising bolt holes 41 are arranged at a predetermined interval on the outer circumference of the open end face 1A of the body 1. Bolt holes 21 are formed in the cover 2 at positions corresponding to the bolt holes 41. The cover 2 is tightened to the body 1 by screwing bolts passing through the bolt holes 21 of the cover 2 into the bolt holes 41.

A loop-shaped seal ring groove 14 of predetermined depth is formed in the inner circumference of the opening end face 1A, as shown in FIG. 5. As shown in FIG. 1 and FIG. 2, a loop-shaped low pressure seal ring 15 is embedded in the seal ring groove 14, and pressed in and gripped between the end face 2A of the cover 2 and the seal ring groove 14. The low pressure seal ring 15 seals hydraulic fluid in the low pressure intake chamber 10 and the branch passages 13, 13.

Figure 8:
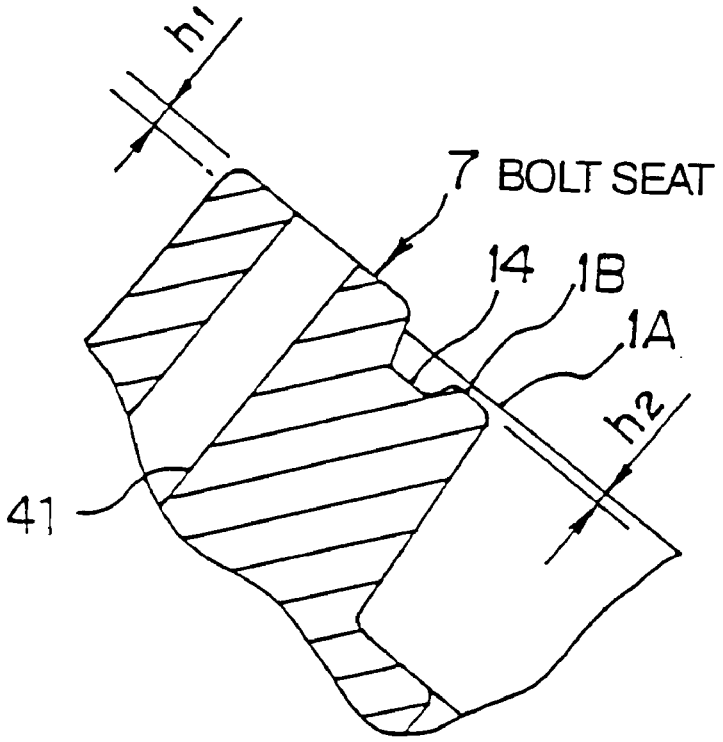
FIG. 8 is a cross-sectional view taken along a line G—G of FIG. 5.

An end face 1B, which is lower by a height h2 than the open end face 1A, is partially formed on the inside of the seal ring groove 14 facing the intake chamber 10 and branch passages 13, as shown in FIG. 6–FIG. 8.

The four bolt seats 7 which are formed at predetermined positions are higher by a height h1 than the open end face 1A, as shown in FIG. 8. The bolt seats 7 extend toward the cover 2. When bolts, not shown, which pass through the bolt holes 21 formed in the cover 2, are screwed into the bolt holes 41 in the bolt seats 7, the end face 2A of the cover 2 comes in contact with the body 1 only at the plural bolt seats 7. When the seal ring 15 is pushed into and gripped between the end face 2A and the seal ring groove 14, the inside of the body 1 is sealed from the outside. A gap h1 depending on the extending height of the bolt seats 7 is formed between the end face 1A of the body 1 and the end face 2A of the cover 2, so that the seal ring 15 is exposed to the outside between the bolt seats 7. The end face 1B is not formed near the lower outer circumference of the cam ring 30, but the lower outer circumference of the cam ring 30 supports the internal circumference of the seal ring 15.

Next, a ring groove 52 engaging with a cir clip 33 and a spline 53 for restricting relative rotation with the rotor 31 are formed on the drive shaft 50 driving the rotor 31 in sequence from the tip end 50A extending towards the escape hole 24 of the cover 2, as shown in FIG. 1.

The ring groove 52 and splines 53 at the tip end 50A are formed with a predetermined outer diameter. The base end 50B side of the drive shaft 50 is supported in the body 1 by a bearing 18. The base end 50B side of the drive shaft 50 which is joined to the pulley 51 is formed of a part 55 having a larger outer diameter than a small diameter part 54. A step 56 is formed between this large diameter part 55 and small diameter part 54.

The step 56 is situated more to the right than the side plate 8 in FIG. 1, FIG. 11. The small diameter part 54 of the drive shaft 50 passes through an axial hole 80 in the side plate 8.

A shoulder part 1E extends toward the small diameter part 54 of the drive shaft 50 so as to come in contact with the end face of the step part 56 when a displacement Δx of the drive shaft 50 to the left of FIG. 1, FIG. 11, exceeds a predetermined value.

When the displacement of the drive shaft 50 to the left of the figure exceeds Δx, the step 56 comes in contact with the shoulder part 1E, and displacement to the left of the figure is restricted. Due to this, the tip end 50A of the drive shaft 50 is prevented from coming in contact with the base of the escape hole 24 of the cover 2.

Even when the drive shaft 50 displaces in such a direction as to make it fall out of the body, i.e. toward the right of FIG. 1, FIG. 11, the displacement of the drive shaft is restricted by the cir clip 33 and the rotor 31 which slide on the side plate 8. The gap Δx between the step 56 and shoulder part 1E is set to a predetermined value where 0<Δx when the cir clip 33 comes in contact with the rotor 31 as shown in FIG. 11. As there is the gap Δx in the axial direction between the step part 56 and shoulder 1E, thermal expansion of the drive shaft 50 can be absorbed.

Herein, the positioning of the intake area and discharge area of the cam ring 30, the low pressure port 82 and high pressure port 81 of the side plate 8, and the low pressure port 6A formed in the cover 2 is performed by two dowel pins 42, 42 engaging with a pair of holes 30A, 30A formed in the cam ring 30 as shown in FIG. 2 and FIG. 10.

The base ends of these dowel pins 42, 42, are pressed into the holes 84, 84 formed in the end face 8B of the side plate 8 facing the cam ring 30, as shown in FIG. 9. The inner diameter of these holes 84 and outer diameter of the dowel pins 42 may be set so that they fit tightly together.

When the engaging hole 30A of the cam ring 30 is passed over the dowel pin 42 of which the base is joined to the side plate 8, the cam ring 30 is positioned so that the intake area and discharge area correspond to the low pressure port 82 and high pressure port 81 of the side plate 8 respectively.

Figure 10B:
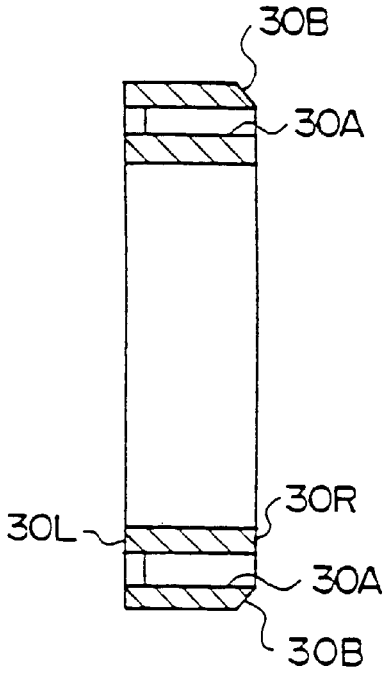

A taper part 30B is formed to make hydraulic fluid flow smoothly on an end face 30R on the side plate 8 side of the cam ring 30, and automatically distinguish one side from another side of the cam ring 30, as shown in FIG. 10(B).

When the cam ring 30 is passed over the dowel pin 42, and the end face 30R of the cam ring 30 is brought in contact with the end face 8B of the side plate 8, the tip of the dowel pin 42 extends by a predetermined amount from an end face 30L of the cam ring 30 facing the cover 2 (FIG. 10 (B)).

When the side plate 8 and cam ring 30 are inserted into the concave space 1C formed in the inner circumference of the body 1, the end of the dowel pin 42 extends by a predetermined amount towards the cover 2 from the bolt seats 7 of the body 1 as shown in FIG. 5 and FIG. 8.

A concave part 25 and an engaging groove 26 of predetermined depth in which the bases of the dowel pins 42 are engaged free to move, are respectively formed in the end face 2A of the cover 2 as shown in FIG. 4(A). The engaging groove 26 opens into the inner circumference of the branch groove 6, and absorbs dimensional tolerances and errors in the dowel pins 42, 42 implanted in the side plate 8. The groove 26 engages with one end of the dowel pin 42, and the cover 2 is thereby joined to the side plate 8 in a predetermined positional relationship as described hereafter with the dowel pin 42 engaged free to move in the concave part 25 as an axis.

This concave part 25 and engaging groove 26 are arranged in a predetermined positional relationship such that the intake area of the cam ring 30 faces the low pressure ports 6A, 6A of the branch groove 6 formed in the cover 2. The bases of this concave part 25 and engaging groove 26 do not come in contact with the ends of the dowel pins 42 in the state wherein the side plate 8 is housed in the body 1, a predetermined gap being formed between the bases of the concave part 25 and engaging groove 26 and the ends of the dowel pins 42.

Next, the action of the vane pump having the aforesaid construction will be described.

When the drive shaft 50 is driven via the pulley 51, the rotor 31 in the pump cartridge 3 rotates. Hydraulic fluid supplied from the intake connector 5 and surplus flowrate from the flowrate control valve 4 flow into the intake chamber 10 formed in the body 1 via the low pressure passage 9.

The pump cartridge 3 comprising the vanes 32, rotor 31 and cam ring 30 then aspirates hydraulic fluid substantially uniformly from the left and right of FIG. 2 and FIG. 4 from the low pressure ports 6A, 82 via the branch passages 13, 13 formed from the top to the sides along the inner circumference of the body 1 and the upper outer circumference of the cam ring 30, and the branch grooves 6,6 formed in the cover 2.

Hydraulic fluid supplied under pressure from the high pressure port 81 of the side plate 8 is led to the flowrate control valve 4 via the high pressure chamber 12 and the passage 11 in the body. The required flowrate is supplied to the power steering device from the discharge port, not shown, and surplus flowrate is recirculated to the low pressure passage 9. This recirculated surplus flowrate is combined with hydraulic fluid from the intake connector 5, enters the intake chamber 10 again, and is supplied to the branch passages 13 and grooves 6.

On the end face 2A of the cover 2, a discharge pressure acts on a high pressure chamber 22 facing the discharge area of the cam ring 30 and the vane back pressure groove 23. However, the outer circumference of the cam ring 30 is covered by the low pressure intake chamber 10 from the upper part to the sides. As the outer circumference of the high pressure area is surrounded by a low pressure area, leakage of hydraulic fluid can be prevented only by the seal ring 15 which seals the low pressure intake chamber 10.

The body 1 and cover 2 come in contact via the bolt seats 7 which extend by the predetermined amount hi from the open end face 1A of the body, as shown in FIG. 5 and FIG. 8. The seal ring 15 is exposed to the outside between the plural bolt seats 7 from the gap h1 between the open end face 1A of the body 1 and the end face 2A of the cover 2. The seal ring 15 is only required to seal low pressure hydraulic fluid, and there is therefore no oil leakage due to fluctuation of pump discharge pressure. Consequently, oil leakage can be definitively prevented simply by pressing in and gripping the seal ring between the end face 2A and the seal ring groove 14.

The drive shaft 50 is supported only by the bearing metal 18 fixed in the axial hole 100 of the body 1. By forming the escape hole 24 in the cover 2 to avoid contact with the tip end 50A of the drive shaft 50, it is unnecessary to support the drive shaft 50 on the cover 2 side as was required in the aforesaid prior art. As a result, construction of the cover 2 is simple, the number of component parts and machining points are reduced, and production costs are reduced. Also, the dimensions of the cover 2 in the axial direction are reduced, and the pump can be made more compact and lightweight.

As it is necessary only to form the branch grooves 6, concave part 25 and engaging groove 26 in a concave shape in the end face 2A and form the bolt holes 21 in the cover 2, the cover 2 may be formed by die-casting.

As for the end face 1A of the body 1, it is necessary only to machine the bolt seats 7 which come in contact with the end face 2A of the cover 2 after diecasting the body 1. As the end faces 1A, 1B themselves do not require machining, machining time after casting is reduced, productivity is improved and production costs are reduced.

Figure 12A:
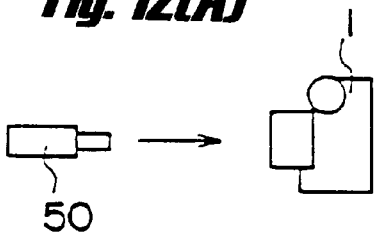
FIG. 12 is a schematic explanatory drawing of the steps involved in assembling the vane pump. (A) shows a shaft assembly step, (B) shows a pump cartridge assembly step, (C) shows a cover assembly step, and (D) shows a step for tightening the cover to the body. (B-1), (B-2) show pump cartridge sub-assembly steps. (B-1) shows a dowel pin insertion step, and (B-2) shows a pump cartridge and side plate assembly step.
Figure 12A:
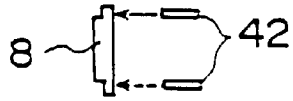
Figure 12A:
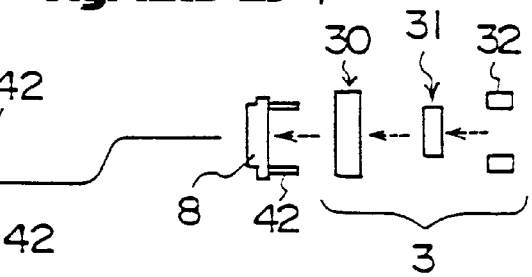

In this vane pump, the intake chamber 10 and branch passages 13, 13 can be formed by passing the cam ring 30 over the dowel pin 42 which has been pressed into the side plate 8 to assemble the pump cartridge 3 in a prior step, and then assembling the finished cam ring 30 and side plate 8 in the body. One example of this assembly step will be described with reference to FIG. 12. FIG. 12(A)≅(D) show a main assembly step, and (B-1), (B-2) show sub-assembly steps.

First, in FIG. 12(A), after assembling parts such as the bearing metal 18 and flowrate control valve 4 inside the body 1, the small diameter part 54 of the drive shaft 50 is passed through the bearing metal 18 from the open end face 1A of the body 1.

Figure 12B:
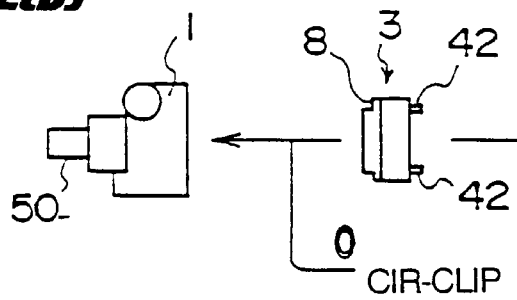

In FIG. 12(B), the side plate 8 and pump cartridge 3 which have been pre-assembled in sub-assembly steps, are installed in the body 1 from the side of the side plate 8, and the rotor 3 is engaged with the splines 53 of the drive shaft 50.

In the sub-assembly steps for assembling the pump cartridge 3 and side plate 8, in FIG. 12(B-1), the base ends of the dowel pins 42, 42 are pressed into the holes 84, 84 of the side plate 8.

In FIG. 12(B-2), the engaging holes 30A, 30A of the cam ring 30 are passed over the tips of the dowel pins 42 whereof the base ends are joined to the side plate 8. With the side plate 8 and cam ring 30 in contact, the rotor 31 and vanes 32 are attached to the cam ring 30, and the side plate 8 and pump cartridge 3 are assembled in a one-piece construction.

In the main assembly step (B), the cir clip 33 is clipped on the drive shaft 50 to which the rotor 31 is attached so as to join the rotor 31 and drive shaft 50. As mentioned above, the step 56 of the drive shaft 50 comes in contact with the shoulder 1E formed in the axial hole 100 of the body 1. Displacement of the drive shaft 50 to the left of FIG. 1 is thereby restricted, the cir clip 33 restricts the displacement of the drive shaft 50 via the rotor 31 and side plate 8 in a direction which would make it fall out of the body 1, and the pump cartridge 3, side plate 8 and drive shaft 50 are thereby prevented from falling out of the body 1.

Figure 12C:
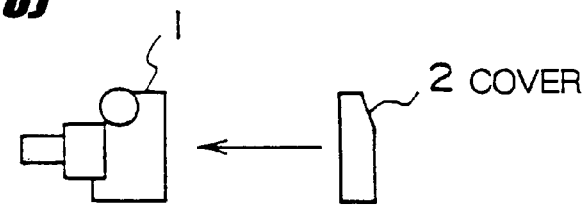

After the pump cartridge 3 and side plate 8 are installed in the body 1, the cover 2 is attached to the open end face 1A of the body 1 as shown in FIG. 12(C).

In attaching the cover 2, the bolt hole 21 and bolt hole 41 which are formed respectively in the body 1 and cover 2 are aligned, the end face 2A of the cover 2 is brought in contact with the bolt seats 7 of the body 1, and the dowel pins 42, 42 which extend towards the cover 2 from the bolt seats 7 are engaged with the concave part 25 and engaging groove 26 formed on the end face 2A of the cover 2.

To join the cover 2 with the ends of the dowel pins 42, one of the dowel pins 42 is first freely engaged with the concave part 25 and the other dowel pin 42 is engaged with the engaging groove 26 as shown in FIG. 4(A).

Herein, one side of the engaging groove 26 is open so as to connect with one of the branch grooves 6, and absorb dimensional tolerances and errors in the dowel pins 42 implanted in the side plate 8. The engaging groove 26 engages with the end of the dowel pin 42. The cover 2 rotates around the dowel pin 42 which is engaged free to move in the concave part 25 as axis, and engages with the side plate 8 in a predetermined positional relationship as described hereafter.

Figure 12D:
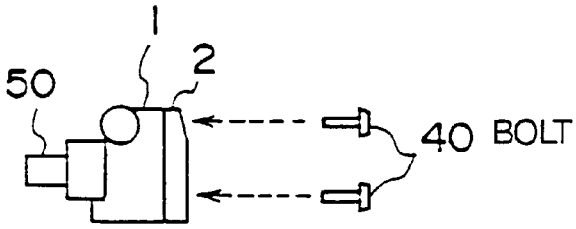
Figure 13:
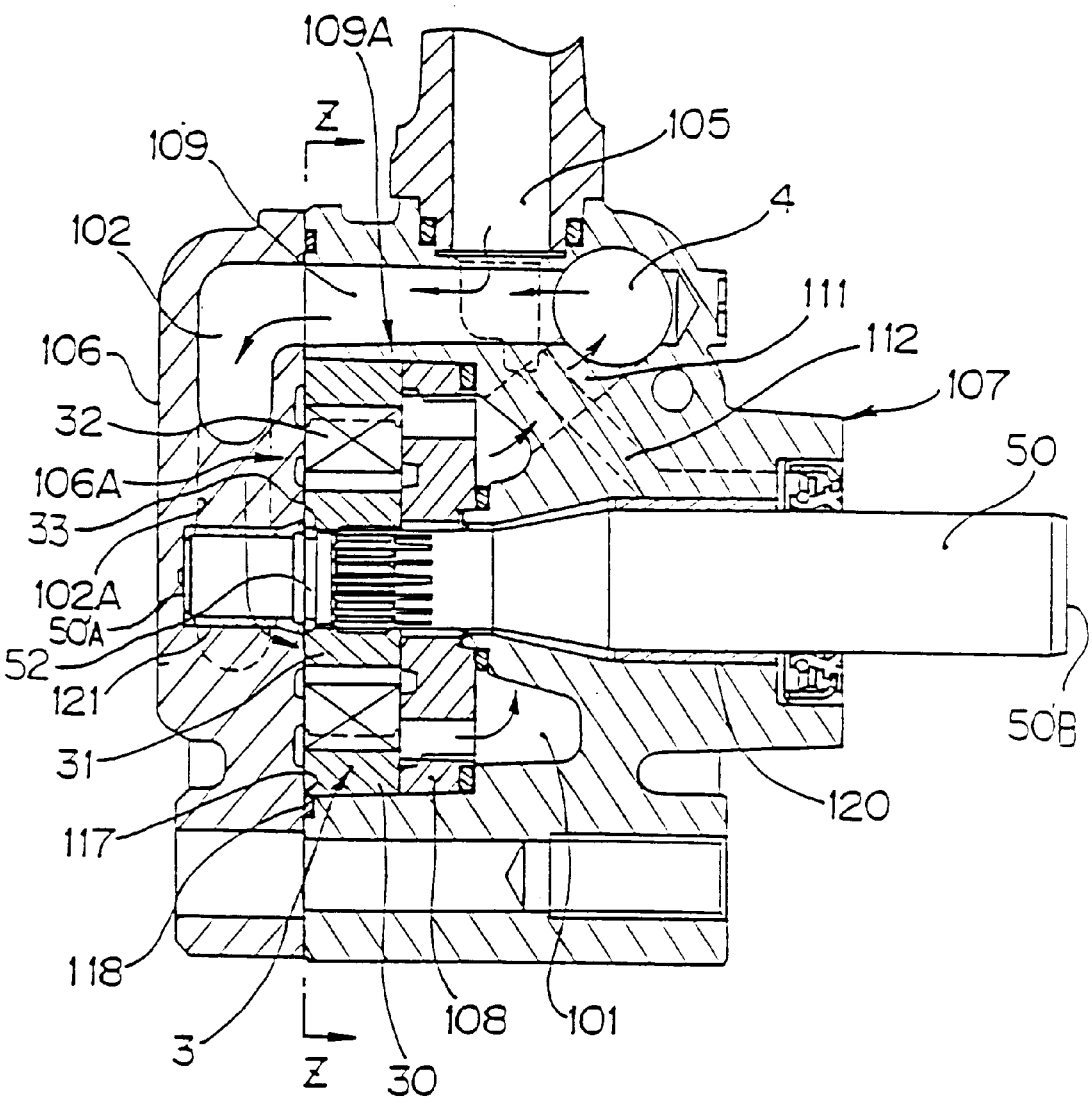
Fig. 13 Prior Art
FIG. 13 is a cross-sectional view of a vane pump according to the prior art.
Figure 14:
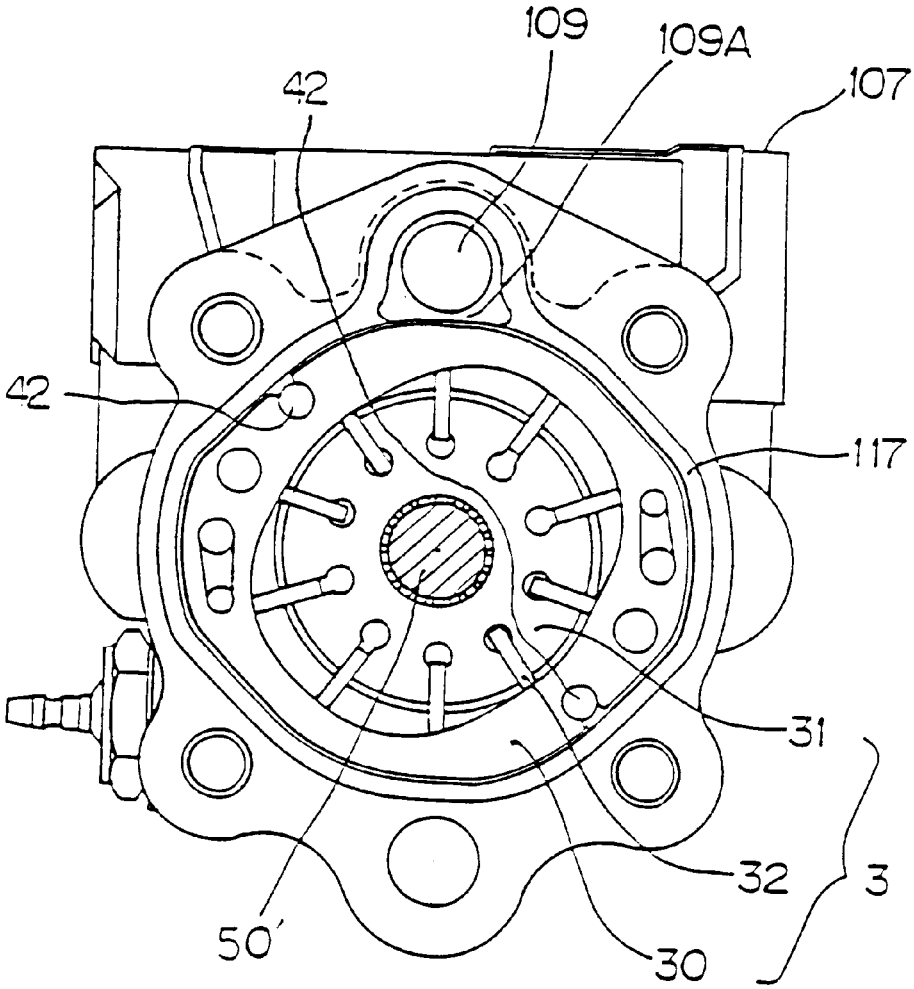
Fig. 14 Prior Art
FIG. 14 is a view taken in the direction of the arrow Z of FIG. 13.

After the concave part 25 and engaging groove 26 are respectively engaged with the dowel pins 42, 42 in the cover 2 in this manner, bolts 40 are tightened in the bolt holes 21, 41 as shown in FIG. 12(D). Due to this, the cover 2, pump cartridge 3 and side plate 8 are joined in a predetermined positional relationship. Specifically, the high pressure port 81 of the side plate 8 is assembled facing the high pressure chamber 12 of the body 1, and the branch grooves 6 of the cover 2 are assembled facing the low pressure passage 9.

In this way, the vane pump can be assembled simply by passing the cam ring 30 over the dowel pin 42 pressed into the side plate 8 in another step, installing the rotor 31 and vanes 32 in sequence, and fitting these parts and the cover 2 to the body 1. Compared with the aforesaid prior art which assembles all the parts In attaching the cover 2, the bolt hole 21 and bolt hole 41 which are formed respectively in the body 1 and cover 2 are aligned, the end face 2A of the cover 2 is brought in contact with the bolt seats 7 of the body 1, and the dowel pins 42, 42 which extend towards the cover 2 from the bolt seats 7 are engaged with the concave part 25 and engaging groove 26 formed on the end face 2A of the cover 2.

To join the cover 2 with the ends of the dowel pins 42, one of the dowel pins 42 is first freely engaged with the concave part 25 and the other dowel pin 42 is engaged with the engaging groove 26 as shown in FIG. 4(A).

Herein, one side of the engaging groove 26 is open so as to connect with one of the branch grooves 6, and absorb dimensional tolerances and errors in the dowel pins 42 implanted in the side plate 8. The engaging groove 26 engages with the end of the dowel pin 42. The cover 2 rotates around the dowel pin 42 which is engaged free to move in the concave part 25 as axis, and engages with the side plate 8 in a predetermined positional relationship as described hereafter.

After the concave part 25 and engaging groove 26 are respectively engaged with the dowel pins 42,42 in the cover 2 in this manner, bolts 40 are tightened in the bolt holes 21,41 as shown in FIG. 12(D). Due to this, the cover 2, pump cartridge 3 and side plate 8 are joined in a predetermined positional relationship. Specifically, the high pressure port 81 of the side plate 8 is assembled facing the high pressure chamber 12 of the body 1, and the branch grooves 6 of the cover 2 are assembled facing the low pressure passage 9.

In this way, the vane pump can be assembled simply by passing the cam ring 30 over the dowel pin 42 pressed into the side plate 8 in another step, installing the rotor 31 and vanes 32 in sequence, and fitting these parts and the cover 2 to the body 1. Compared with the aforesaid prior art which assembles all the parts separately in the body 1, assembly of the pump cartridge 3 in the body 1 is easier and faster. Productivity is considerably improved, assembly costs are reduced, the assembly steps can be automated, and production costs are reduced by labor saving.

Displacement of the drive shaft 50 towards the cover 2 is restricted by the step 56 and the shoulder part 1E of the body 1. The drive shaft 50 is supported only by the bearing metal 18 in the body 1, and the tip end 50A of the drive shaft 50 that extends from the body 1 is housed inside the escape hole 24 formed in the end face 2A of the cover 2. Due to this, there is no need for bearings or precision finishing of a surface in the cover 2 on which the drive shaft slides when it displaces in axial direction as in the aforesaid prior art. Also, there is no need to perform dimensional control such as orthogonality of the drive shaft 50 and the end face 2A of the cover 2, or concentricity of the drive shaft 50 and the axial hole, the number of parts and processing time are largely reduced, and production costs can be further reduced.

INDUSTRIAL APPLICATION

In the vane pump according to this invention, the number of cover machining steps is reduced and the number of assembly steps is largely reduced, so vane pump productivity is improved. In addition, assembly steps can be automated.

What is claimed is:

1. A vane pump, comprising:

a cam ring comprising a rotor joined to a drive shaft, and vanes provided in said rotor such that they are free to move in or out, a body supporting said drive shaft and housing said cam ring, a side plate on which are symmetrically provided first low pressure ports corresponding to an intake area of said cam ring and a high pressure port corresponding to a discharge area and connected to a high pressure chamber in said body, an intake chamber formed between an inner circumference of said body and an upper outer circumference of said cam ring, said intake chamber connecting with a low pressure passage for leading hydraulic fluid from the outside, a branch passage formed between said inner circumference of said body and said upper outer circumference of said cam ring connecting said first low pressure ports of said side plate with said intake chamber, a cover comprising an end face joined to an open end face of said body which comes in contact with one end face of said cam ring, wherein second low pressure ports are symmetrically arranged as depressions at positions corresponding to said intake area of said cam ring, and a low pressure distributing groove provided as a depression connected to said intake chamber which splits into two along said upper outer circumference of said cam ring towards said second low pressure ports, and a pin implanted in said side plate whereof a tip extends by a predetermined amount from said open end face of said body towards said cover, wherein a throughhole is formed in said cam ring through which said pin passes, a concave part of predetermined depth is formed in said cover which engages with said tip of said pin, and an escape hole of predetermined depth for housing a tip end of said drive shaft is formed in said end face of said cover at a position corresponding to said drive shaft.

2. A vane pump as defined in claim 1, wherein at least one set of said pin is symmetrically provided in said side plate, plural througholes for passing said pins through are formed in said cam ring, and plural concave parts joined to tips of said pins in said end face of said cover are symmetrically formed relative to said drive shaft supported by said body.

3. A vane pump as defined in claim 1, wherein said pin is pressed into a hole formed in said side plate.

4. A vane pump as defined in claim 2, wherein said pin is pressed into a hole formed in said side plate.

5. A vane pump as defined in claim 1, wherein said drive shaft is joined to said rotor in an axial direction by a cir clip, said drive shaft comprises a small diameter part having a predetermined diameter on said cover side and a large diameter part having a larger diameter than said small diameter part on said body side, said large diameter part is supported by said body, a step is formed between said small diameter part and said large diameter part, and a shoulder part is provided which comes in contact with said step at an end of a shaft hole in said body.

* * * * *